US007404238B2

(12) United States Patent
McNeill

(10) Patent No.: US 7,404,238 B2
(45) Date of Patent: Jul. 29, 2008

(54) SECURING STRAP

(75) Inventor: Stephen Robert McNeill, Port Macquarie (AU)

(73) Assignee: Diane Maree McNeill, Port Macquarie (AU)

( * ) Notice: Subject to any disclaimer, the term of this patent is extended or adjusted under 35 U.S.C. 154(b) by 0 days.

(21) Appl. No.: 11/129,587

(22) Filed: May 13, 2005

(65) Prior Publication Data

US 2005/0251967 A1 Nov. 17, 2005

(30) Foreign Application Priority Data

May 13, 2004 (AU) ..... 2004902567

(51) Int. Cl.
*B65D 63/10* (2006.01)

(52) U.S. Cl. ..... 24/16 PB

(58) Field of Classification Search ..... 24/16 R, 24/16 PB, 17 A, 17 AP, 30.5 P, 484; 248/60, 248/74.3; 292/318, 321, 325, 307 A
See application file for complete search history.

(56) References Cited

U.S. PATENT DOCUMENTS

| | | | | |
|---|---|---|---|---|
| D252,741 | S * | 8/1979 | Taylor | D9/434 |
| D370,407 | S * | 6/1996 | Pietrowski | D8/394 |
| 5,581,850 | A * | 12/1996 | Acker | 24/16 PB |
| 2003/0159254 | A1 * | 8/2003 | Wendle | 24/16 PB |

FOREIGN PATENT DOCUMENTS

WO WO 2068289 A1 * 9/2002

* cited by examiner

*Primary Examiner*—James R Brittain
(74) *Attorney, Agent, or Firm*—Gordon & Jacobson, PC

(57) ABSTRACT

A securing strap for use independently or in combination with one or more similar straps. The securing strap includes a head portion and a shank portion. The head portion includes a first slot as well as first and second arrowhead shaped portions each having a neck portion. The arrowhead shaped portions are positioned in a head to tail relationship. The shank portion includes a second slot. The neck portion of the first arrowhead portion is adapted to engage the first slot. The neck portion of the second arrowhead portion is adapted to engage the second slot.

1 Claim, 8 Drawing Sheets

SECURING STRAP

FIELD OF THE INVENTION

This invention relates to securing straps. It relates, more particularly, to an adjustable strap for hanging coils of wire, ropes, chains, garden hoses, etc.

SUMMARY OF THE INVENTION

In a first form the present invention provides a securing strap adapted for use independently or in combination with one or more similar straps, the or each said securing strap including a head portion and a shank portion, said head portion including first and second arrowhead shaped portions, each said arrowhead shaped portion having a neck portion, said arrowhead shaped portions being positioned in a head to tail relationship, said shank portion including first and second slots, said neck portion of said first arrowhead portion being adapted to engage a said first slot, said neck portion of said second arrowhead portion being adapted to engage a said second slot.

Preferably said neck portion of said first arrowhead shaped portion is adapted to engage one of said slots of said shank portion of said strap to thereby form a first loop, and said neck portion of said second arrowhead portion is adapted to engage the other of said slots of said shank portion of said strap to thereby form a second loop.

Preferably said first arrowhead shaped portion is positioned at an end of the head portion of the or each said securing strap.

More preferably, the arrangement is such that the second loop is within the first loop.

Preferably said first loop is adapted to be looped around a coiled body.

More preferably said second loop is adapted to receive a portion of an elongated member forming said coiled body.

The securing strap can be made of a bendable material.

Preferably said securing strap is made of a resilient material.

More preferably said securing strap is made of a resilient and compressible material.

Preferably said securing strap is made of an elastomeric material.

Preferably said securing strap further includes attachment means for securing said securing strap to a supporting body.

Preferably the size of said first loop is adjustable.

In a second form the present invention provides a method for hanging a coiled body, said body being formed by looping an elongated member, said method including the step of applying a resilient securing strap to said coiled body such that a first portion of said securing strap supports said coiled body, and a second portion of said securing strap supports an end of said elongated member.

BRIEF DESCRIPTION OF THE DRAWINGS

Embodiments of the invention will be described below, by way of example only, with reference to accompanying drawings in which.

DETAILED DESCRIPTION OF THE EMBODIMENTS

Figure 1:
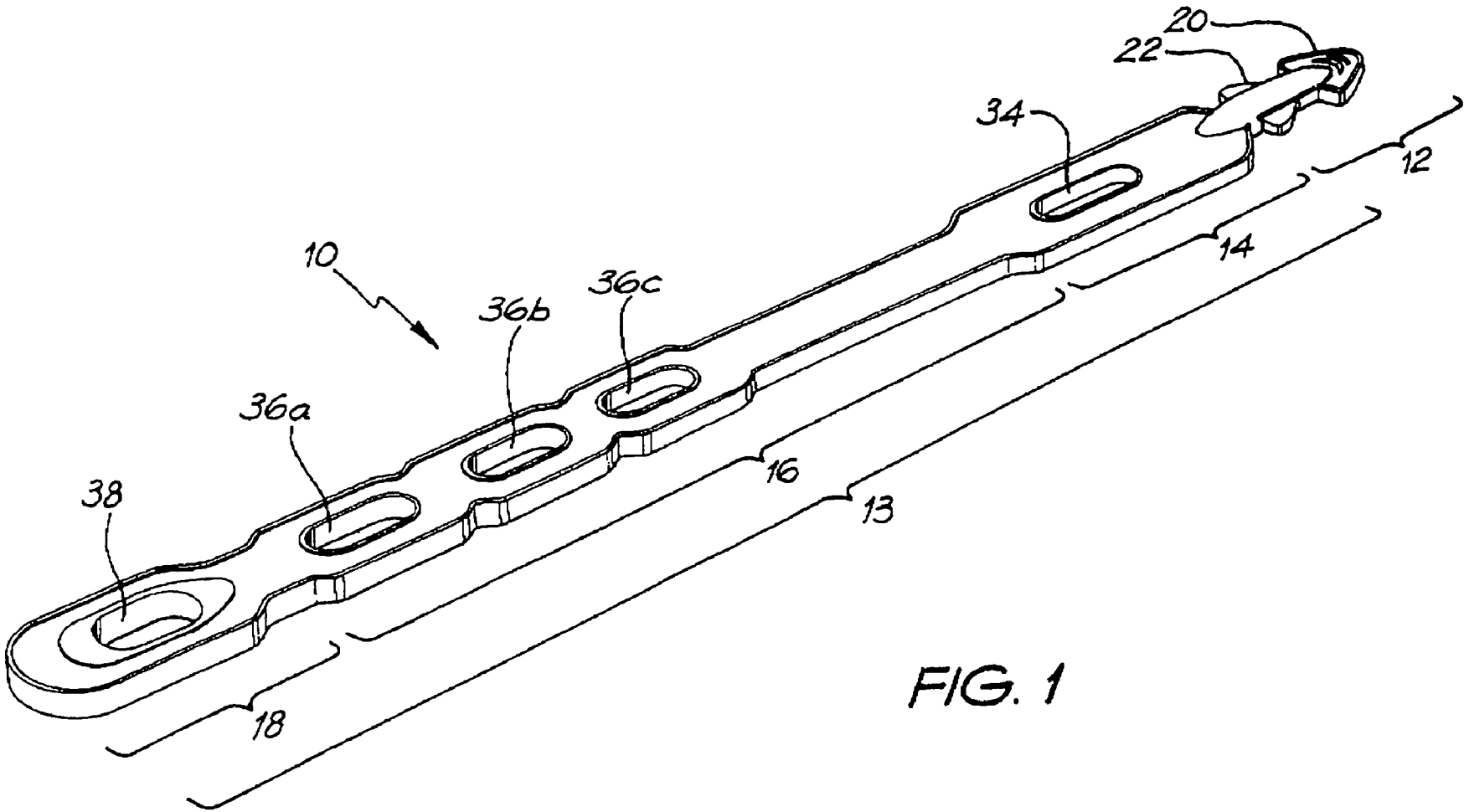
FIG. 1 is a perspective view of a securing strap according to the present invention.
Figure 2:
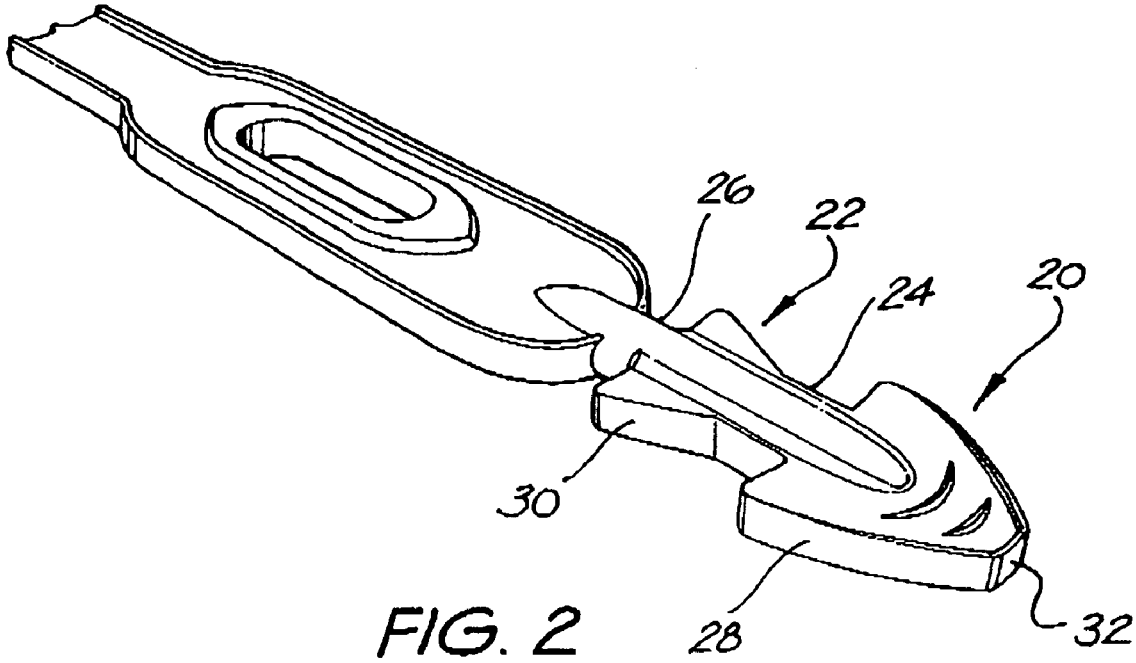
FIG. 2 is a fragmentary perspective view of the strap of FIG. 1, illustrating the details of a head portion of the strap.
Figure 3:
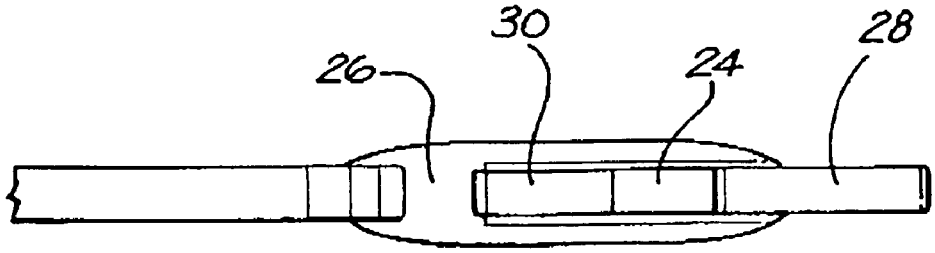
FIG. 3 is a fragmentary side view of the strap of FIG. 1, illustrating the details of the head portion of the strap.

Referring now to the drawings, a securing strap 10 embodying the principles of this invention is shown in FIGS. 1-3. The securing strap 10 is in the form of an elongated body having a head portion 12 and a shank portion 13. The shank portion 13 is in the form of a relatively thin and flat strip and includes a loop portion 14, a locking portion 16, and a hanging portion 18.

The head portion 12 includes two arrowhead shaped portions 20 and 22 connected in a head-to-tail manner. Each arrowhead shaped portion (20,22) includes a narrow neck portion (24, 26) and a V-shape body portion (28, 30). The body portion 28 terminates to a tip 32.

In a preferred embodiment, the head portion 12 is substantially thicker than the shank portion 13. More preferably, the thickness of the arrowhead shaped portion 22 is approximately twice the thickness of the shank portion 13. The length of the neck portion 26 is approximately equal to the thickness of the shank portion 13.

The loop portion 14 of the shank portion 13 includes a longitudinal slot 34 (a proximal slot) through which the head portion 12 may be inserted. In a preferred embodiment, the width of the slot 34 is approximately equal to the width of the neck portion 26.

The locking portion 16 includes a plurality of longitudinal slots 36*a*, 36*b*, and 36*c* (distal slots) through which the arrowhead shaped portion 20 can be inserted. Preferably the width of the slots 36*a*, 36*b*, 36*c* is approximately equal to the width of the neck portion 20. The overall length of the locking portion 16 and or the number of slots 36 will depend on the desired use of the securing strap 10.

The hanging portion 18 includes an aperture 38 for securing the securing strap 10 to a wall or another supporting structure.

In a preferred embodiment, the securing strap 10 is in the form of a one-piece member made of a flexible resilient and compressible material (eg, elastomeric materials, rubber-like materials, latex, etc). In other embodiments the securing strap 10 is made of a bendable material such as plastics, leather, etc.

It will be appreciated by those skilled in the art that the securing strap can be made of any other suitable material, including fabric, metals, etc.

Likewise, different elements and or sections of the securing strap 10 can be manufactured from different materials, for example the hanging portion can be manufactured from a metal and then attached to the locking portion 16 during a succeeding manufacturing step. Similarly the slots 34, 36, and 38 can be reinforced to increase the durability of the securing strap 10.

Figure 4:
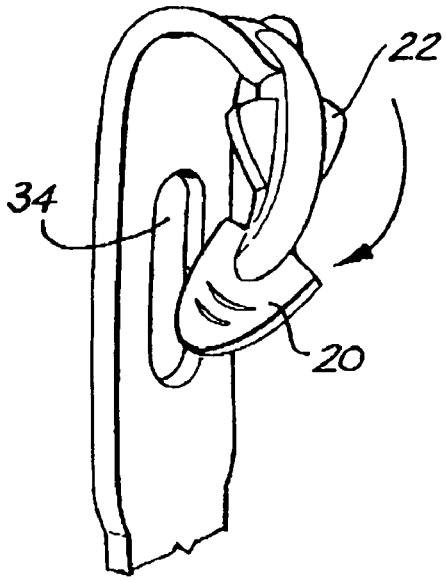
FIG. 4 is a schematic illustration of a method of inserting the head portion of the strap of FIG. 1 into a slot of a loop portion of the strap.
Figure 5:
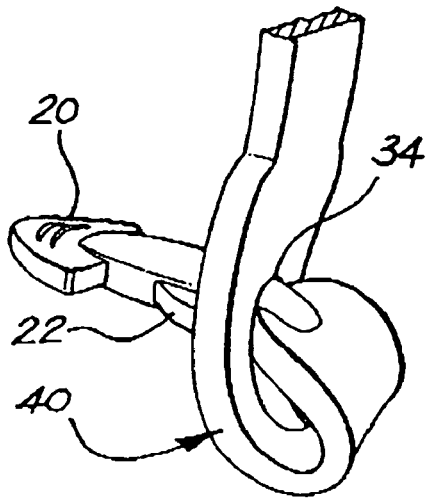
FIG. 5 is a fragmentary isometric view of the strap of FIG. 1 with the head portion looped through a proximate slot of the strap.

Referring now to FIG. 4, the head portion 12 is inserted and locked into the slot 34 by first forming a loop and then twisting the head portion 90 degree so that the head portion 12 can pass through the slot 34 until the neck portion 26 is aligned with the slot 34. The head portion 12 is then twisted 90 degree back to its original position. Alternatively, the user can insert the head portion 12 into the slot 34 by moving the side edges of the slot 34 apart to widen the slot 34 (not shown), if the material of the strap 10 allows it. As illustrated in FIG. 5, the neck portion 26 is locked in the slot 34 to thereby form a loop 40, the purpose of which will be described later in this patent specification.

Figure 6:
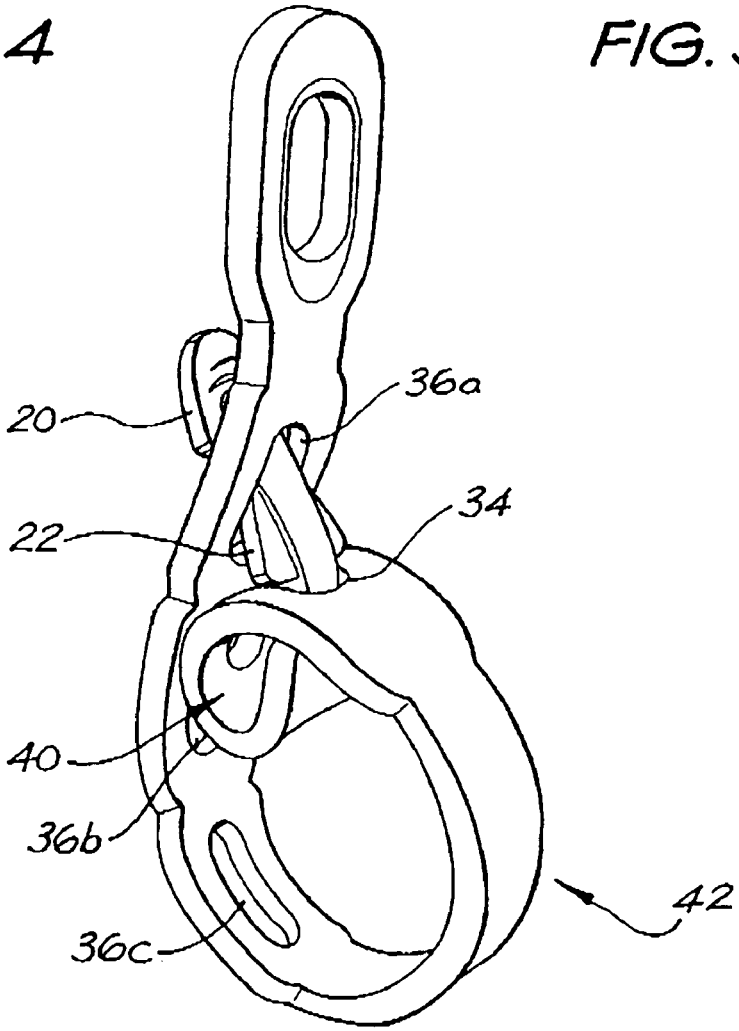
FIG. 6 is a schematic isometric view of the strap of FIG. 1 with the head portion looped through a distal slot of the strap.
Figure 7:
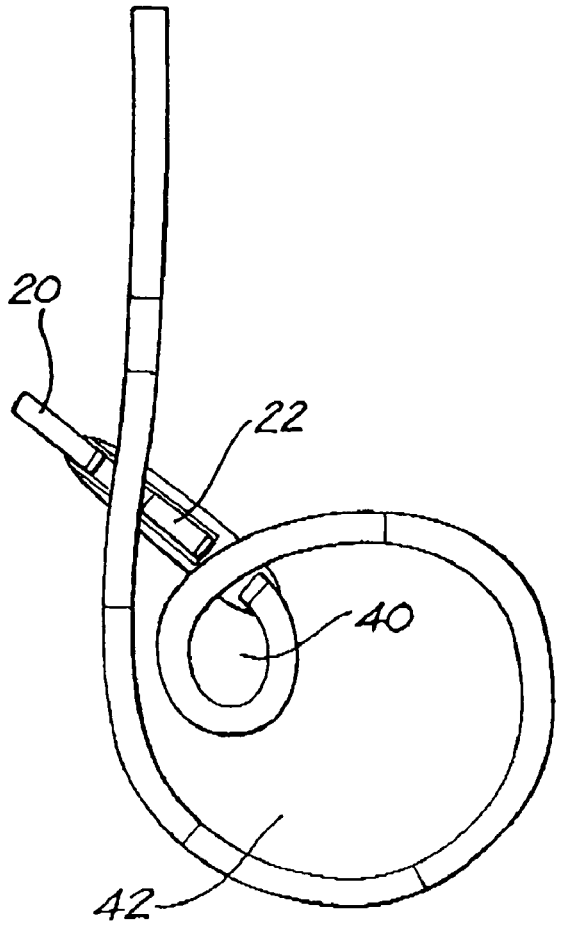
FIG. 7 is a schematic side view of the strap of FIG. 6.

As illustrated in FIGS. 6 and 7, the arrowhead portion 20 is then inserted into one of the slots 36 (eg, the slot 36*a*) in a manner similar to the discussed above in relation to the loop 40. As a result, a locking loop 42 is formed. As best illustrated in FIG. 7, the locking loop 42 is of a larger diameter that the loop 40. The size of the locking loop 42 can be adjusted by selectively positioning the arrowhead portion 20 for locking engagement with one of the locking slots 36.

Figure 8:
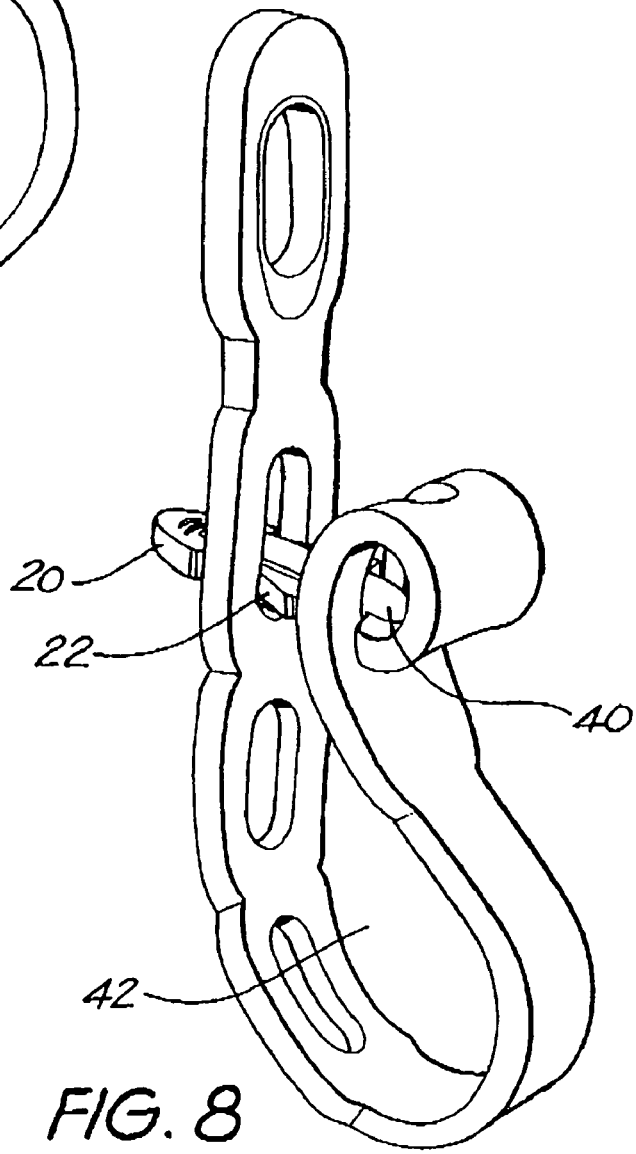
FIG. 8 is a schematic view of the strap of FIG. 1 wherein the second loop is formed outside the first loop.

In an alternative embodiment illustrated in FIG. 8, the loop 40 can be positioned outside the locking loop 42 so that the securing strap can support two articles (eg, cables, etc) in a spaced relationship.

Figure 9:
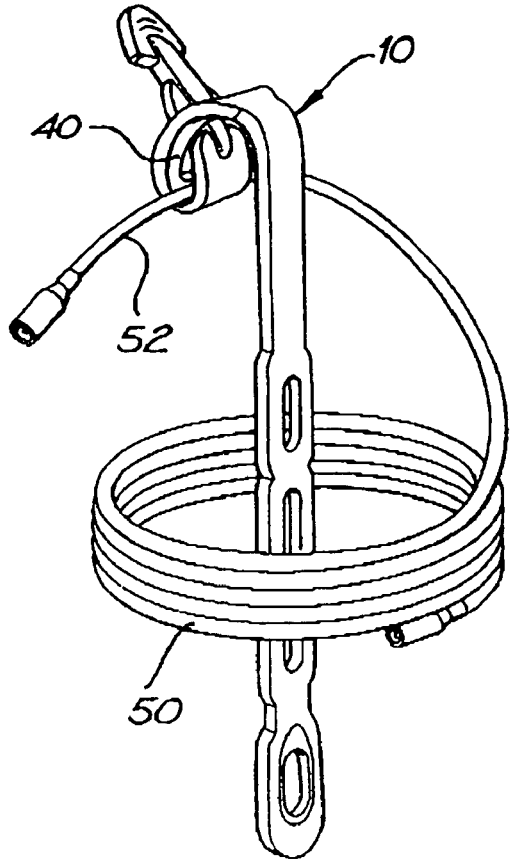
FIG. 9 illustrates an initial position of a coiled body.
Figure 10:
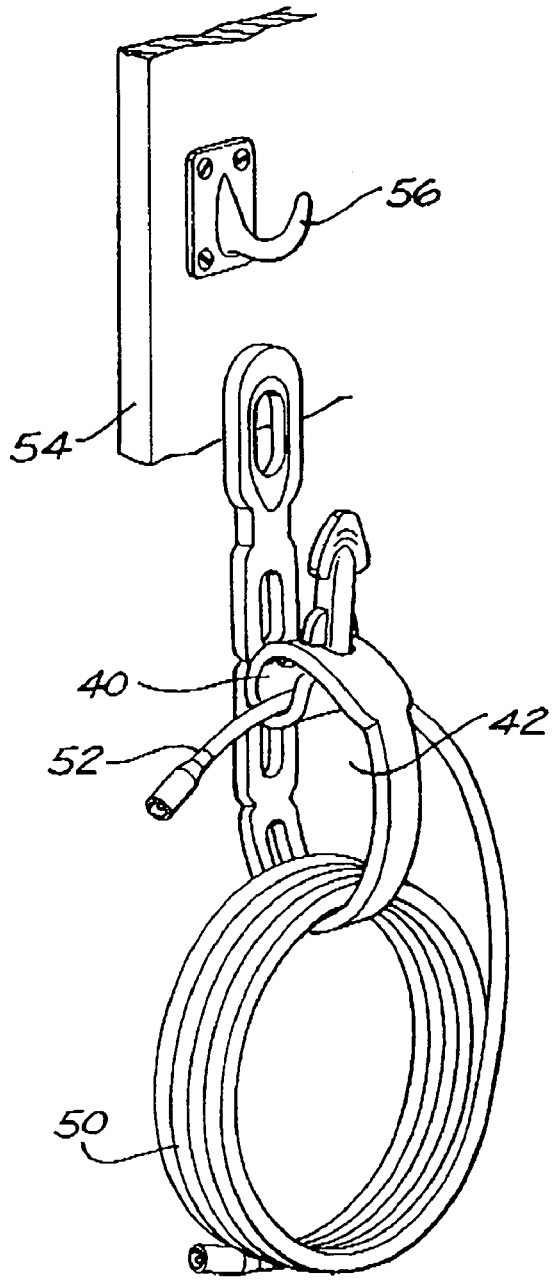
FIG. 10 illustrates the securing strap of FIG. 1 supporting the coiled body of FIG. 9.
Figure 11:
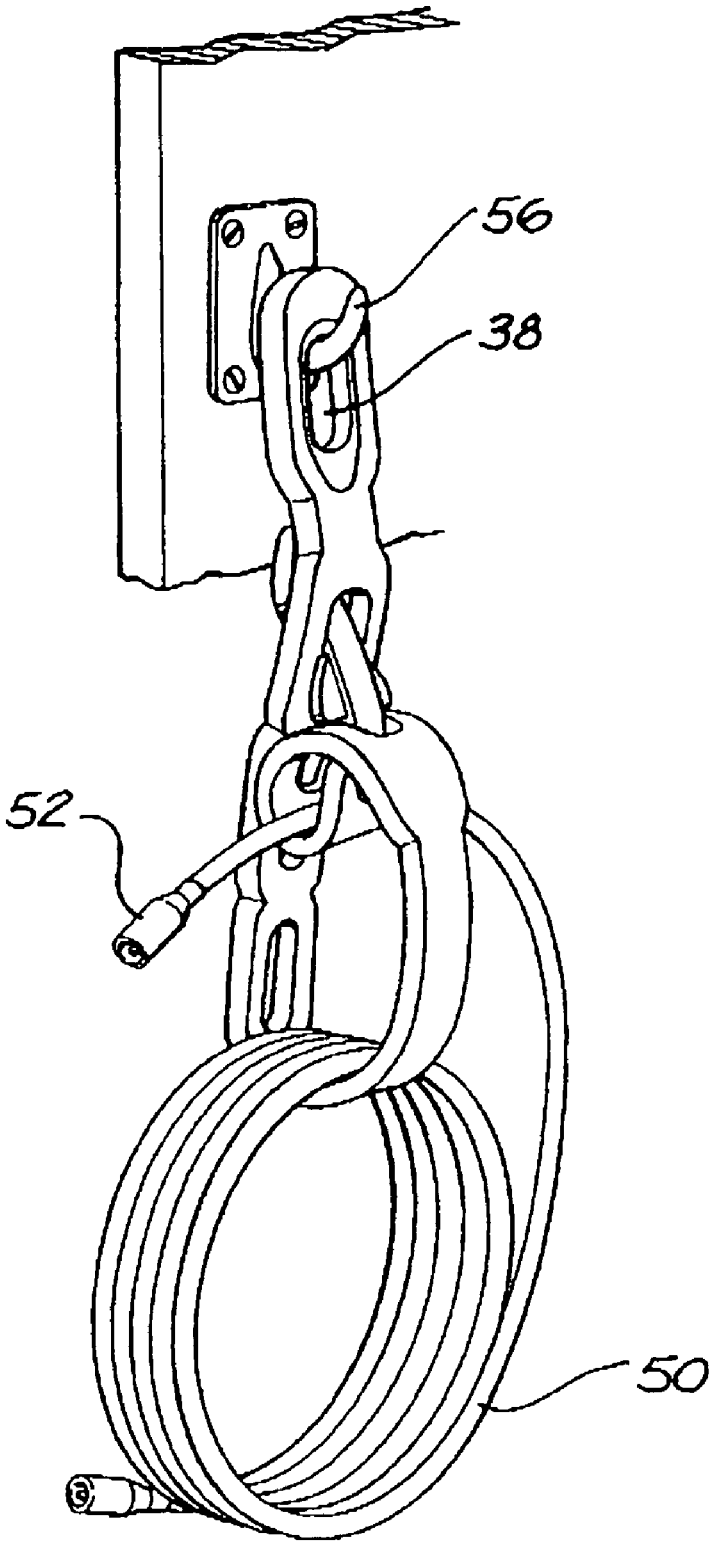
FIG. 11 illustrates the securing strap of FIG. 1 in a final position.
Figure 12:
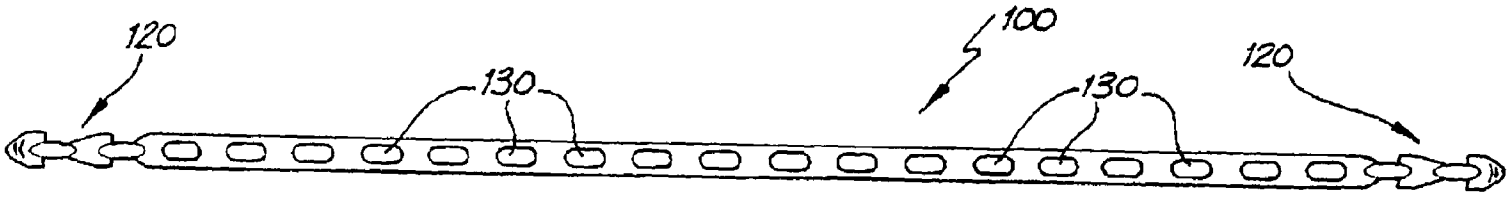
FIG. 12 is a plan view of a securing strap according to a second embodiment of the present invention.

In use, a user inserts the securing strap 10 through a coil of wire 50 so that an end 52 of the wire 50 passes through a pre-formed loop 40, as schematically illustrated in FIG. 9. Alternatively, the user can form the loop 40 by looping the head portion 12 about the end 52 of the coil 50. The user then forms the locking loop 42 by passing the arrowhead portion 20 through a slot 36 so that the loop 42 fits around the coil of wire, as illustrated in FIG. 10. The securing strap 10 can then be attached to a hook 56 secured to a wall 54 or to any other suitable support member, as shown in FIG. 11. It will be appreciated by those skilled in the art, that the hanging portion 38 may include any attachment means known in the prior art.

As it was mentioned earlier, in a preferred embodiment the securing strap 10 is made of rubber. Due to the resiliency of this material the securing strap 10 will stretch under the weight of the coil of wire, compressing the wire, the internal loop 40, and the neck portions 24, 26, and preventing disengagement of the head portion 12 and the shank 13. In addition, due to the fact that this material is compressible, frictional contacts between different portion of the securing strap and between the securing strap and the coil of wire will further contribute to the safety of the device.

Illustrated in FIGS. 12-15 is a securing strap 100 according to a second embodiment of the present invention. Similarly to the embodiment shown in FIGS. 1-11, the securing strap 100 includes a shank portion provided with a plurality of locking slots 130. The strap 100 further includes two head portions 120 located at ends of the strap 100. The head portions 120 are similar to those illustrated in FIGS. 1-11 and include two arrowhead shaped portions positioned in a head to tail relationship.

Figure 13:
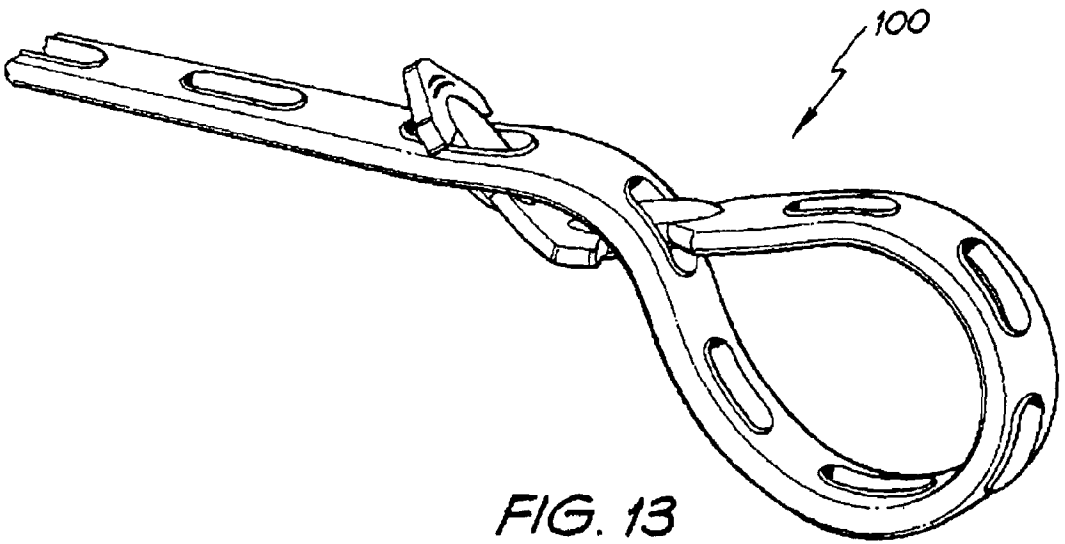
FIG. 13 is a schematic view of the strap of FIG. 12 wherein a second loop is formed outside a first loop.
Figure 14:
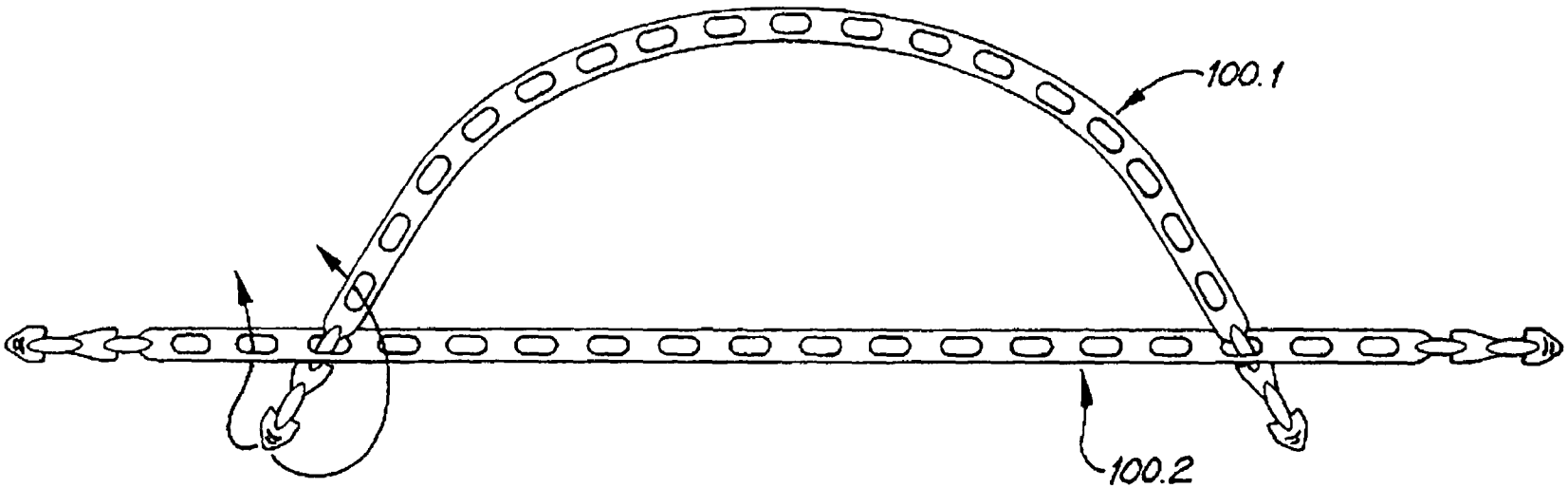
FIG. 14 illustrates the use of the strap of FIG. 12 in combination with a similar strap.

As illustrated in FIG. 13, the securing strap 100 can be used as a separate securing device. Alternatively, the securing strap can be used in combination with one or more similar straps 100.1 and 100.2 to form a loop of a larger diameter (see FIG. 14). To this end, the arrowhead shaped portion of the strap 100.1 can be locked in a slot of the strap 100.1 or a slot of the securing strap 100.2.

Figure 15:
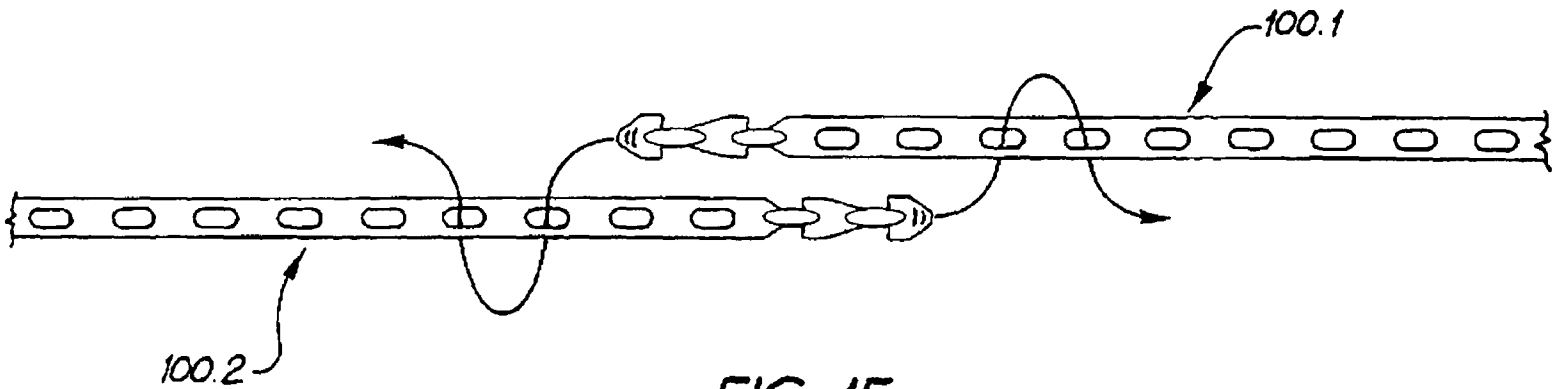
FIG. 15 illustrates a modified use of the straps of FIG. 14.

As illustrated in FIG. 15, the securing straps 100.1 and 100.2 can be used in a combination to provide a securing strap of an increased length (see FIG. 15).

It will be understood that the invention disclosed herein extends to alternative combinations of two or more of the individual features mentioned or evident from the text. All of these combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

It will further be understood that any reference herein to known prior art does not, unless the contrary indication appears, constitute an admission that such prior art is commonly known by those skilled in the art to which the invention relates.

The invention claimed is:

1. A securing strap adapted for use independently or in combination with one or more similar straps, said securing strap including:

a first head portion at one end thereof and a second head portion at the opposite end thereof, each said head portion including first and second arrowhead shaped portions, each said arrowhead shaped portion having a neck portion, said arrowhead shaped portions being positioned in a head to tail relationship; and a middle portion disposed between said first head portion and said second head portion and including a first slot and a second slot, wherein said neck portion of said first arrowhead shaped portion is adapted to engage said first slot, and wherein said neck portion of said second arrowhead shaped portion is adapted to engage said second slot.

* * * * *

UNITED STATES PATENT AND TRADEMARK OFFICE

CERTIFICATE OF CORRECTION

PATENT NO. : 7,404,238 B2
APPLICATION NO. : 11/129587
DATED : July 29, 2008
INVENTOR(S) : Steven Robert McNeill It is certified that error appears in the above-identified patent and that said Letters Patent is hereby corrected as shown below:

Title page item 75, the inventor's complete name "Stephen Robert McNeill" is corrected to --Steven Robert McNeill--

Signed and Sealed this

Thirtieth Day of September, 2008

JON W. DUDAS
*Director of the United States Patent and Trademark Office*